United States Patent [19]

Woodruff

[11] 4,122,644

[45] Oct. 31, 1978

[54] HEAT-INSULATING FIBROUS PANELS

[75] Inventor: Richard K. Woodruff, Dundee, Ill.

[73] Assignee: Refractory Products Co., Carpentersville, Ill.

[21] Appl. No.: 764,208

[22] Filed: Jan. 31, 1977

[51] Int. Cl.[2] ..... E04C 5/00

[52] U.S. Cl. ..... 52/787

[58] Field of Search ..... 52/617, 596, 597, 511, 52/372, 375, 373, 374, 705, 707; 110/1 A; 432/247, 248, 252

[56] References Cited

U.S. PATENT DOCUMENTS

| | | | |
|---|---|---|---|
| 1,959,083 | 5/1934 | Marl | 52/597 |
| 2,009,615 | 7/1935 | Hall | 52/511 |

*Primary Examiner*—John E. Murtagh

*Attorney, Agent, or Firm*—Fitch, Even, Tabin & Luedeka

[57] ABSTRACT

A heat-insulating panel is made by disposing a metal supporting member adjacent a felting screen to lay down a wet refractory fiber mat from an aqueous, refractory fiber-colloidal silica mixture about the metal member. The member has a central base section and a pair of wings extending in opposite directions from opposite edges of the central section, with the wings being disposed at an angle of between about 130° and about 80° to each other and each containing a plurality of holes. After drying, the member is embedded within the mat with individual fibers extending through the holes and firmly anchoring the member. The member is located adjacent the rear surface of the heat-insulating panel, and its central section contains an aperture through which a support rod is passed to mount the panel.

6 Claims, 7 Drawing Figures

HEAT-INSULATING FIBROUS PANELS

This invention relates to improved heat-insulating panels and more particularly to refractory fiber panels which are designed to insulate the interior walls of a high-temperature enclosure.

The interior walls of kilns, furnaces and the like wherein combustion is being carried out to create high temperatures must generally be thermally insulated in order to conserve energy. Various methods have been developed for attaching heat-insulating panels, coverings or the like to surfaces being insulated. For example, U.S. Pat. No. 1,251,830 shows the use of metal bands with punched-out tongues which extend through a region between insulating blocks or panels and then fit through slots in a similar band that can, in turn, be used to support another course of insulation. U.S. Pat. No. 2,656,902 to Gotshall shows the attachment of clips to the metal surface to be insulated that receive headed pins upon which the insulating panels are impaled and then held in position by retainers placed on the ends of the pins. U.S. Pat. No. 3,158,459 shows a multiple layer insulation structure wherein none of the fasteners which hold the layers in place extend through all of the layers, as would otherwise provide a heat flow path completely therethrough. U.S. Pat. No. 3,477,493 shows a wire-reinforced, shaped insulating panel which maintains its position as a result of its peripheral shape. U.S. Pat. No. 3,670,917 shows a heat-insulating structure wherein multiple panels are supported on studs of synthetic insulating material which extend all the way through the panel arrangement.

The present invention provides improved panels made from refractory fibers that are capable of withstanding the high temperatures to which they will be subjected inside furnaces or the like and that are designed to facilitate their connection to the surface being insulated. Moreover, the invention provides a method for making these improved heat-insulating panels wherein supporting members for holding the panels in their operative positions are incorporated therewithin as an integral part of the panel-forming process.

Other features of the invention will be apparent by reading the following detailed description in conjunction with the accompanying drawings wherein.

Figure 1:
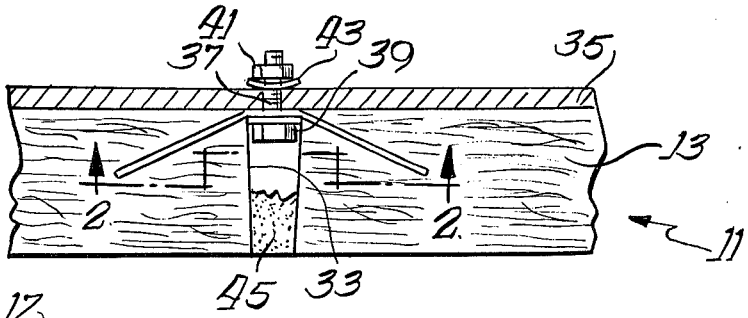
FIG. 1 is a sectional view through a panel embodying various features of the invention which is shown supported in operative position adjacent the upper wall of a furnace enclosure, with portions being broken away.
Figure 2:
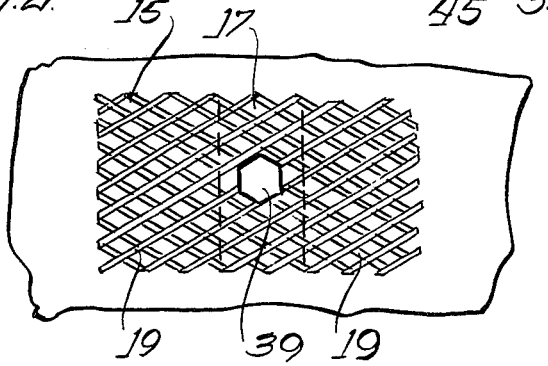
FIG. 2 is a view of the supported panel taken generally along the line 2—2 of FIG. 1.

Very generally, the invention provides an improved refractory panel 11 which is formed of a mat or felt 13 of refractory fiber material and has supporting members or clips 15 integrally anchored therein. The clips 15 are formed of a foraminous material, for example, wire screening or expanded metal. Although the shape of the perimeter of the clips 15 is not of functional importance, the illustrated clips are rectangular and are bent to form a center or base section 17 and a pair of wings 19 which extend at angles from the base section. As a result of the shape of the clips 15, they are sometimes referred to as butterfly clips. A central aperture 21 is formed in the base section 17.

In the illustrated arrangement, each panel 11 is provided with two supporting metal clips 15 although this is dependent solely upon the size of the panel, and if the panels were made larger in size, it is generally desirable to provide a greater number of supporting clips 15. The illustrated panels 11 are intended to represent panels which are approximately two inches thick and about one foot by three feet in size. The clips 15 are located adjacent the "cold" or rear surface of the panel 11, which is defined as that surface which is opposite from the surface that faces the heat source. Thus, the major portion of the thickness of the refractory fiber mat 13 serves to insulate the metal clip 15 from the very high temperature environment of the furnace enclosure. However, the clips 15 are still formed from relatively high temperature-resistant stainless steel or other suitable metal alloy, such as a high nickel alloy like those sold under the designation Inconel. The thickness of the material from which the clips are made may vary from about 0.03 in. to about 0.06 in.

Figure 4:
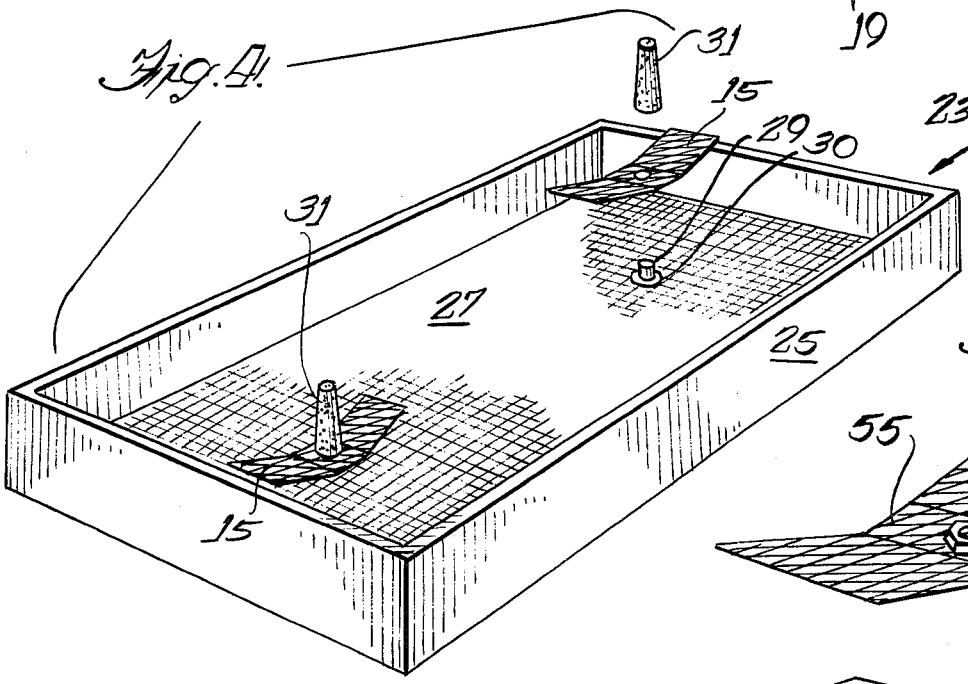
FIG. 4 is a perspective view with a portion shown in exploded fashion which is illustrative of the forming method that is employed to fabricate the panel.

FIG. 4 of the drawings illustrates a typical felting box or device 23 which has been modified to form the improved panels 11. Basically, the felting box includes an upstanding outer or permimeter wall 25 across the bottom of which is stretched a felting screen 27 — all being common in this art. Refractory fiber mats of this general type are made by supplying a slurry of refractory fibers and water plus a colloidal inorganic binder to the felting box and by using either pressure or suction to cause the water to drain downward through the screen thereby depositing the fibers on the screen to build up a layered mat of the desired thickness. Sufficient of the colloidal inorganic binder remains with the still wet fibers to rigidly interconnect the fibers at their points of contact with one another after evaporation of the remainder of the water during firing of the refractory fiber mat.

In producing the improved panel, the usual felting box is modified by providing a pair of pegs 29 extending upward from the felting screen 27. The pegs 29, in the illustrated embodiment, are located along the longitudinal center line of the felting box 23, spaced generally evenly from the two shorter walls in order to position the clips 15 in the desired locations in the finished panel 11. The pegs 29 can be made of any suitable material, for example, brass or stainless steel, and are appropriately connected to the felting screen 27, as by soldering or brazing.

A butterfly clip 15 is placed over each of the upstanding pegs 29 so that the undersurface of the clip base section 17 rests upon, or closely adjacent to, the upper surface of the felting screen 27. Omission of the flange 30 would position the base 17 of the clip substantially flush with the rear surface of the panel. In the illustrated embodiment, the pegs 29 are provided with a base flange 30 which spaces the clip 15 just slightly above from the felting screen 27. The peg 29 protrudes through the central aperture 21 in the clip 15 and extends thereabove sufficiently to support a generally conical filler or consumable pin 31. The consumable pin 31 has a cavity formed in its bottom which receives the peg 29 and sits upon the butterfly clip 15 in the manner shown in FIG. 4. The height of the consumable pin 31 is sufficient so that it will extend at least up to the top of the fibrous mat that is being formed in the felting box 25. Installed in this fashion, the base sections 17 of each butterfly clip 15 is substantially parallel to the plane of the felting screen 27, and the wings 19 extend diagonally upward at an angle which is preferably between about 25° and about 50° to the plane of the base section. The importance of the angular orientation is discussed hereinafter.

When the pair of butterfly clips 15 and the consumable pins 31 are in position, the felting operation is begun by supplying the fibrous aqueous slurry to the felting box 23. As the water is drawn through the felting screen 27, thin layers of intertwined fibers begin to build up atop the screen. In a felting process of this type, the layers form what amounts to a plurality of generally parallel planes disposed one atop another. The holes in the foraminous material from which the metal clips 15 are made should be of sufficient size so that the fibers can easily extend therethrough. In this respect, wire screening or expanded metal having holes dimensioned between about ½ inch and about 1 inch is preferably employed. As a result, the refractory fibers, which may often be between about 0.5 inch and about 1.5 inch in length and have an average diameter of about 2.5 microns, will extend through the holes in the foraminous wing sections 19 as they are laid down in the felting process. Because the fibers bond to one another in the drying step, they exhibit a much longer effective length in the final product. Moreover, the fibers intertwine with one another on opposite sides of the wings and unite the wings with the fiber layers which constitute the mat.

When the mat 13 of fibers has built up to the desired thickness, the felting operation is terminated, and the panel is removed from the felting box 23 and dried. Drying is carried out to remove the remainder of the water from the wet fibers leaving the colloidal inorganic binder on the surface of the fiber. Drying can be carried out in any suitable manner, and usually a circulating hot air oven is used which is operated at a temperature of between about 300° and about 600° F. Generally, colloidal silica is used as the binder; however, other colloidal inorganic oxides may also be employed. Upon removal of the water, the colloidal silica creates a strong bond between the refractory fibers at the points of intersection with one another where they are in touching contact.

Usually, the refractory fibers which are employed are formed from inorganic oxides or the like, such as silica, zirconia, alumina, berylia, titania and mixtures thereof. One type of fibers which may be employed are alumina-silicate fibers, such as those available under the tradename "Fiberfax" from the Carborundum Company which have an approximate composition by weight of aluminum oxide 51.3 percent, silicon dioxide 47.2 percent, boron oxide 0.5 percent, sodium oxide 0.15 percent, with the remainder being trace inorganics. Colloidal silica, which is commercially available as an aqueous dispersion of small spherical particles of silicon dioxide that are negatively charged, is the preferred inorganic binder. However, similar aqueous dispersions of other colloidal particles such as colloidal alumina or colloidal zirconia may also be employed. Colloidal silica is commercially available in aqueous dispersons of amounts up to about 50 percent by weight of silica, and this feature, plus its attractive comparative price, makes it attractive for use in production operations.

As earlier indicated, any well-known felting process can be used, and the aqueous fibrous slurry can be supplied to the felting box or the felting box can be immersed in a tank wherein the slurry is contained. The latter is often accomplished by providing a suction chamber below the illustrated felting box from which the water is removed after it has been drawn through the felting screen. In such an operation, a time sequence is generally used, and the felting box will be immersed in the slurry while the suction is employed for a specific length of time.

Although the felt will obtain its desired strength by drying at any temperature, preferably firing is carried out at an elevated temperature so as to simultaneously dry the felt to set the binder while the consumable pin 31 is being removed by disintegration or otherwise. In this respect, the temperature is dependent upon the material from which the consumable pin 31 is made. For example, it could be formed from core molding sand, in which case it may crumble after heating at a fairly low temperature to remove the binder. Alternatively, should it be made from wood fibers, e.g., an oxidizable material, such as papier-mache, it can be burned out in a circulating air oven at a temperature of at least about 400° F. Generally, an oven temperature of between about 400° F. and about 600° F. is used to dry the mat and remove the consumable pin 31 in a reasonable time, for example, an hour or less.

The dried panels 11, when ready for use, have a pair of the butterfly clips 15 disposed adjacent the rear or cold surface. Moreover, a general frusto-conical void region 33 extends from the central aperture 21 of the clip through the total thickness of the panel 11 to the front surface which will face the high temperature source.

FIG. 1 illustrates the panel as being used to insulate the upper wall or ceiling 35 of a furnace or kiln. Holes 37 can be drilled in the metal wall 35 at the desired location, and a short bolt 39 (of a high-temperature-resistant metal), with a washer attached if desired, may be inserted through the void chamber 33 left by the consumable pin, through the central aperture 21 and then through the drilled hole 37 in the furnace wall 35. In an instance where the furnace structure is made of a material such as expanded metal, there will likely already be openings at the desired locations in the furnace wall so that drilling will not be needed. The panel 11 is secured in position by the placement of a nut 41 and lock washer 43 on the threaded end of the bolt 39.

Once the panel 11 has been mounted in its operative position, the cavity 33 is filled with suitable plug 45 of insulation material, for example, a wad of a damp refractory fiber mass of the same material as that from which the panel is formed. The frusto-conical shape of the cavity 33 prevents the plug 45 from falling out, and thus the supported panel 11 presents a substantially continuous and unbroken heat insulation surface across its entire front surface.

If, for example, more than about two inches of insulation are required for the temperatures which will be encountered, one or more standard panels without clips can be supported between the clip-bearing panel 11 and the upper wall 35 of the furnace enclosure by using longer bolts. Moreover, because a large temperature drop will take place across the refractory fiber panel 11, it may be possible to use lower temperature insulating material, such as vermiculite board, between the panel 11 and the furnace wall 35. Alternatively, instead of drilling through the wall of the furnace enclosure 35, threaded studs can be welded directly to the metal undersurface of the wall 35 in a desired pattern to register with the central apertures 21 in the clips of the panels. Depending upon the length of the studs, one or more standard panels may be impaled thereupon before the panel 11 is fitted into position, with the threaded ends of the studs protruding downward through the apertures 21 of the clips. A nut is inserted upward through the cavity 33 and threaded onto the end of the stud using a suitable tool, and once the connection is complete, the cavity is then filled with a wet fibrous plug as in the manner indicated hereinbefore.

The butterfly clips 15 provide excellent support for the fibrous panels because, as a result of the felting and drying process, they have become an integral part of the relatively rigid refractory fiber panel 11. As a result of the angular orientation of the wings 19, the clips 15 are firmly anchored within fiber layers which constitute nearly half of the thickness of the panel. A refractory fiber panel formed in this manner, i.e., by laying down successive layers one after another, when subjected to stress during its lifetime of high-temperature operation, may occasionally experience structural failure which, if it occurs, is usually brought on by delamination. However, in the panels 11, the butterfly clips 15 not only don't increase the tendency for delamination to occur, but they actually deter delamination in the support regions. In this respect, the angular orientation of the wings 19, as best seen in FIG. 1, causes the wings to bridge and thus further unite the layers of refractory fiber near the cold surface of the panel — creating a stronger panel in these regions.

To achieve the aforementioned effect of structurally uniting these fiber layers and deterring delamination, the angles that the wings 19 form with the base 17 of the clips 15, and thus the rear surface of the panel 11, should be at least about 25°. On the other hand, it is important that, during the felting operation, the fibers protrude through the holes in the foraminous metal from which the clips 15 are formed, and to assure that adequate protrusion is obtained, the angle should not be greater than about 50°. Thus, looking at the clip 15 itself, the wing sections 19 are disposed at an angle of between about 80° and 130° to each other. It can be seen that as the wings 19 approach a right angle, there would be very little tendency for the fibers to extend through the holes, and thus such wings would substantially form a barrier to the fibers that would create a discontinuity at these locations. As a result, only a fairly weak bond between the fiber mat and the clips would be achieved, and the tendency to experience structural failure at the region of the clips would be a distinct disadvantage to such a construction.

Figure 3:
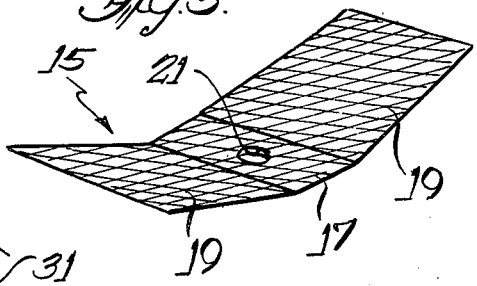
FIG. 3 is an enlarged perspective view illustrating the supporting clip shown in FIGS. 1 and 2.
Figure 5:
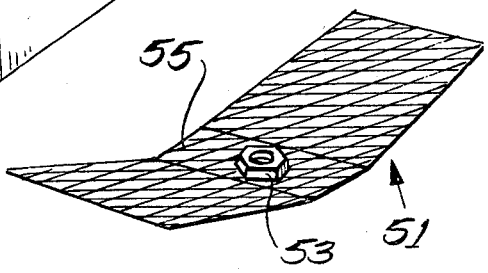
FIG. 5 is an enlarged perspective view of a modified form of a supporting clip.

Depicted in FIG. 5 is a modified embodiment of a butterfly clip 51 which is made generally the same as that shown in FIG. 3 with the exception that in addition it includes a threaded nut 53 which is suitably connected, as by welding or brazing, to the surface of base portion 55 of the clip in alignment with its central aperture 57. Because of the inclusion of the nut 53 as a part of the clip 51, it is not necessary to employ consumable pins in the felting operation, as illustrated in FIG. 4. The peg 29 itself provides a void space leading into the threaded nut 55 from the cold side of the modified panel 59, depicted in FIG. 6, and no access to the clip 51 from the front surface is needed.

Figure 6:
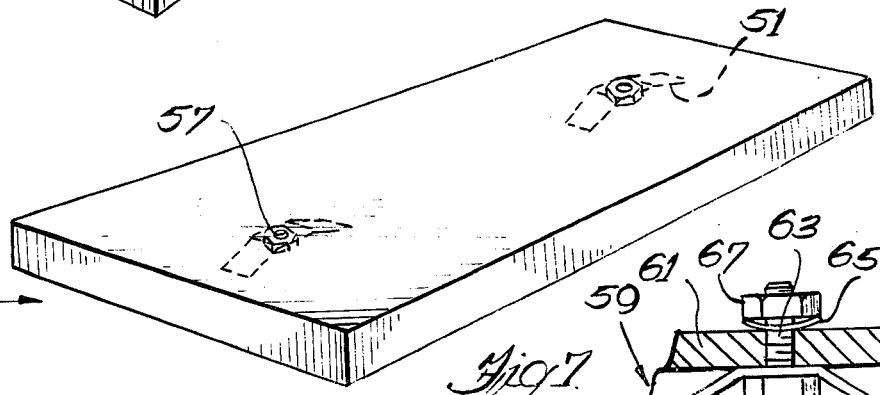
FIG. 6 is a perspective view of a panel made using the modified clips of FIG. 5, showing it in the orientation in which it would be mounted adjacent the upper wall of an enclosure.

The panel 59, including two such butterfly clips 51, can be made on the felting box 23, and in FIG. 6, it is shown in the orientation it would assume in insulating an upper wall or ceiling of a furnace enclosure. The panel 59 resembles the panel 11, with the only difference being the modified clips 51 and the absence of the void cavities 33.

Figure 7:
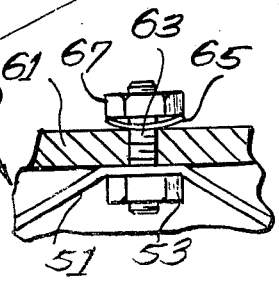
FIG. 7 is an enlarged fragmentary sectional view showing a panel having the construction illustrated in FIG. 6 mounted adjacent the roof of a furnace enclosure.

In order to mount the panels 59 in their operative position, suitable hole patterns are drilled through the upper wall 61 of the enclosure, and then threaded studs 63 are screwed into the nuts 53 and inserted through the holes, as depicted in FIG. 7. The placing of a lock washer 65 and nut 67 on the upper end of the stud 63 above the enclosure wall 61 completes the installation. Alternatively, short bolts can be inserted through the holes in the upper wall 61 and screwed directly into the nuts 53 while the panel 59 is being temporarily supported in place. If a thicker insulation is desired, a standard panel of felt or some other panel can be supported between the panel 59 and the upper wall 61 of the enclosure by using longer studs 63 than those illustrated in FIG. 7.

As an example of a commercially feasible panel embodying features of the invention, alumina-silicate fibers are used together with a colloidal silica binder to produce an insulating board or panel of the type being sold as WRP-XA by Refractory Products Co., Carpentersville, Illinois. Such a two-inch thick panel will withstand a temperature of 2600° F. on its front or hot surface and will drop this temperature to about 2050° F. at the embedded support clip, which can thus be formed of RA330 alloy stainless steel. Testing of the butterfly clips in these improved panels shows that they will support a load of 75 pounds, which is more than adequate to support a four-inch thick backing of insulation board between the panel and the upper wall of the enclosure in a suspender roof or ceiling construction (which would likely add about 20 pounds of weight per clip).

Although the invention has been described in respect of several preferred embodiments, it should be understood that changes and modifications as would be obvious to one having the ordinary skill in the art may be made without departing from the scope of the invention which is defined solely by the appended claims. For example, if the consumable pin is not employed to provide the cavity 33, access to the clip 15 from the front surface of the panel can be provided by drilling.

Various of the features of the invention are set forth in the claims which follow.

What is claimed is:

1. A heat insulating panel having a front surface for placement facing the heat source and an opposite rear surface, which panel comprises a refractory fiber mat formed of discrete refractory fibers bonded together by an inorganic bonding agent, and a metal supporting member embedded within said fiber mat, which member includes a central base section and a pair of wing sections extending in opposite directions from said central section and being disposed at an angle of between about 25° and about 50° to said rear surface, said wing sections each containing a plurality of holes so that said individual fibers extend through said holes and thus firmly anchor said member as an integral part of said mat.

2. A panel in accordance with claim 1 wherein a cavity is provided extending from the front surfact of the panel to said central base section through cavity which a fastener can be inserted.

3. A panel in accordance with claim 1 wherein said central section is generally planar and is disposed closely adjacent the rear surface of the panel.

4. A panel in accordance with claim 1 wherein said central section contains an aperture through which a support rod can be passed.

5. A panel in accordance with claim 4 wherein a threaded nut is affixed to said central section in alignment with said aperture.

6. A panel in accordance with claim 1 wherein said supporting member is formed of expanded metal having holes measuring between about one-half inch and about 1 inch.

* * * * *